US006801887B1

(12) United States Patent
Heikkinen et al.

(10) Patent No.: US 6,801,887 B1
(45) Date of Patent: Oct. 5, 2004

(54) SPEECH CODING EXPLOITING THE POWER RATIO OF DIFFERENT SPEECH SIGNAL COMPONENTS

(75) Inventors: Ari Heikkinen, Tampere (FI); Mikko Tammi, Tampere (FI); Jani Nurminen, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 686 days.

(21) Appl. No.: 09/666,971

(22) Filed: Sep. 20, 2000

(51) Int. Cl.[7] ..... G10L 19/14
(52) U.S. Cl. ..... 704/206; 704/207
(58) Field of Search ..... 704/200–230

(56) References Cited

U.S. PATENT DOCUMENTS

| | | | | |
|---|---|---|---|---|
| 5,517,595 A | | 5/1996 | Kleijn | 395/2.14 |
| 5,884,253 A | | 3/1999 | Kleijn | 704/223 |
| 5,903,866 A | | 5/1999 | Shoham | 704/265 |
| 6,067,518 A | * | 5/2000 | Morii | 704/219 |
| 6,266,644 B1 | * | 7/2001 | Levine | 704/200.1 |
| 6,418,408 B1 | | 7/2002 | Udaya Bhaskar et al. | 704/219 |
| 6,604,070 B1 | | 8/2003 | Gao et al. | 704/222 |

FOREIGN PATENT DOCUMENTS

| | | | |
|---|---|---|---|
| EP | 0657874 | 6/1995 | G10L/9/18 |
| EP | 0663739 | 7/1995 | H04B/14/04 |
| EP | 0666557 | 8/1995 | G10L/9/14 |
| WO | 0019414 | 4/2000 | G10L/21/04 |

OTHER PUBLICATIONS

AT&T Labs–Research; Kang et al.; "Phase Adjustment in Waveform Interpolation"; pp. 261–264; 1999; IEEE.
"A General Waveform–Interpolation Structure for Speech Coding", W. B. Kleijn et al., Signal Processing: Theories and Applications, Proceedings of EUSIPCO, vol. 3, Sep. 13, 1994, pp. 1665–1668.
"Waveform Interpolation for Coding and Synthesis", by W. B. Kleijn and K. K. Paliwal, in "Speech Coding and Synthesis", (Elsevier Science B.V., 1995). pp. 175–207.
"Encoding Speech Using Prototype Waveforms", by W. B. Kleijn, (IEEE Transactions on Speech and Audio Processing, vol. 1, No. 4, Oct. 1993). pp. 386–399.

* cited by examiner

*Primary Examiner*—David D Knepper
(74) *Attorney, Agent, or Firm*—Ware, Fressola, Van Der Sluys & Adolphson LLP

(57) ABSTRACT

A method and system for waveform interpolation speech coding. The method comprises the steps of decomposing the speech signal into a slowly evolving waveform component and a rapidly evolving waveform component in the encoder and determining the power ratio of these surface components so that the power ratio can be used to determine the bit allocation when the surface components are quantized. The power ratio can also be used to modify the phases of the slowly evolving waveform component when the surface components are reconstructed in the decoder in order to improve the speech quality.

18 Claims, 5 Drawing Sheets

SPEECH CODING EXPLOITING THE POWER RATIO OF DIFFERENT SPEECH SIGNAL COMPONENTS

FIELD OF THE INVENTION

The present invention relates generally to a method and apparatus for coding speech signals and, more specifically, to waveform interpolation coding.

BACKGROUND OF THE INVENTION

The rapid growth in digital wireless communication has led to the growing need for low bit-rate speech coders with good speech quality. The current speech coding methods capable of providing speech quality near that of a wire-line network are operated at bit rates above 6 kbps. These bit rates, however, may not be desirable for many wireless applications, such as satellite telephony systems and half bit-rate transmission channels for mobile communication systems. Mobile communication systems set special requirements to a speech coder and, particularly, to its speech quality, bit-rate, complexity and delay. During recent years, the main challenge in the development of speech coders has been to decrease the bit rate while maintaining the wire-line speech quality. As the bit rate decreases, the operation of speech coding algorithms usually becomes more dependent on the characteristics of the input signal. In particular, in a system where a bit-stream is transmitted over a channel, which is exposed to errors, the speech quality can deteriorate significantly. Thus, it is desirable to design a speech coder which is robust enough to avoid channel errors and can recover rapidly from the erroneous speech frames.

During the last decades, many methods have been developed for robust speech coding. One of the most promising low bit-rate speech-coding methods is waveform interpolation (WI) coding. In general, a WI coder extracts a surface from the speech signal in order to describe the development of the pitch-cycle waveform as a function of time. From the extracted surface, the speech signal is further divided into periodic and noise components so that they can be coded separately. For example, in U.S. Pat. No. 5,517,595, Kleijn discloses a method of decomposing noise and periodic signal waveforms for waveform interpolation, wherein a plurality of sets of indexed parameters are generated based on samples of the speech signal, and each set of indexed parameters corresponds to a waveform characterizing the speech signal at a discrete point in time. Parameters are further grouped based on index value to form a set of signals representing a slowly evolving waveform (SEW) and a set of signals representing a rapidly evolving waveform (REW), to be coded separately. In the article entitled "Waveform Interpolation for Speech Coding and Synthesis" (*Speech Coding and Synthesis*, W. B. Kleijn and K. K. Paliwal, Eds., pp. 175-208, Elsevier Science B. V., 1995), Kleijn and Haagen disclose the decomposition of the characteristic waveform and the outline of a WI coding system.

In general, speech signals contain voiced speech periods and unvoiced speech periods. Voiced speech is quasi-periodic and appears as a succession of similar, slowly evolving pitch-cycle waveforms. As such, the pitch-cycle waveform describes the essential characteristics of the speech signal. WI coding exploits this fact by extracting and coding the characteristic waveform in an encoder and then reconstructing the speech signal from the extracted and coded characteristic waveform in a decoder. If the pitch-cycle waveform and a phase function are known for each time instant, then it is possible to reconstruct the original speech signal without distortion. The speech signal can therefore be represented as a two-dimensional surface $u(t,\phi)$, where the waveform is displayed along the phase ($\phi$) axis and the evolution of the waveform along the time (t) axis. This description of the voiced speech characteristics is also valid for the unvoiced speech, which consists essentially of non-period signals.

In a WI speech encoder, a low-pass filter is used to filter the two-dimensional surface $u(t,\phi)$ along the t axis, resulting in a slowly evolving waveforn (SEW). The filtered-out portion of the speech signal is a rapidly evolving waveform (REW). The SEW signal corresponds mainly to the substantially periodic component of the speech signal, while the REW signal corresponds mainly to the noise component. For improving coding efficiency, the quantization of the SEW and the REW signals is usually carried out in a frequency domain where the magnitudes and the phases are quantized separately. In practice, the first operation of most WI coders is to perform a linear prediction (LP) analysis of the speech signal. In the LP analysis, short-term correlations between speech samples are modeled and removed by filtering. The modeled short-term correlations are used to establish a predicted signal. The error signal between the original signal and the predicted signal is the LP residual signal. Only the residual signal is decomposed in a SEW part and an REW component. The predicted signal is represented by a set of LP coefficients.

A WI encoder can be functionally divided into an outer and an inner layer. The outer layer estimates parameters for a current speech frame, and the inner layer encodes these parameters in order to produce a bit stream for transmission through a communication channel or for storage in a storage medium for later use. As shown in FIG. 1, the outer layer determines a set of LP coefficients and extracts a waveform surface in order to describe the development of the pitch-cycle waveform as a function of time. The outer layer also determines the pitch and power of the speech signal. The inner layer decomposes the LP residual speech surface into SEW and REW components and encodes these components separately. The inner layer also quantizes the pitch, the LP coefficients and the power and formats the encoded data into a bit-stream. Likewise, a WI decoder can also be functionally divided into an outer layer and an inner layer, as shown in FIG. 2. In decoding, the inner layer dequantizes the received bit stream in order to determine the parameters for the current speech frame, and the outer layer subsequently reconstructs the speech signal from the decoded parameters. In the encoder, the SEW and REW signals are down-sampled to a desired sampling rate before quantization. In the decoder, the SEW and REW signals are up-sampled before they are reconstructed into a surface representing the LP residual signal. In the prior art WI coder, as shown in FIGS. 1 and 2, the quantization scheme is fixed, regardless of the characteristics of the input signal. This is often true for other types of speech coders, such as Code Excited Linear Prediction (CELP) and sinusoidal coders. This means that the bit allocation in the bit stream is based only on the down-sampling of the SEW and REW signals, but not the relative signal strength between the SEW and the REW components, as a function of time. In particular, in the prior art, the voiced period in the speech signal is emphasized over the unvoiced period, and the quantization accuracy of the SEW waveform is emphasized over the update rate. Typically, the SEW waveform is down-sampled to 50 Hz and quantized using a vector quantization scheme, while the REW waveform is down-sampled to 200 Hz, and the magnitude spectrum of the REW waveform is quantized using only a few shapes. While this bit allocation scheme may be appropriate for the voiced period when the SEW component is dominant, it is not an efficient use of bits in the unvoiced period when the REW is dominant, especially at low bit rates.

It is advantageous and desirable to provide a method and apparatus for waveform interpolation coding with a different bit allocation scheme for more efficient use of bits in low bit-rate speech coding.

SUMMARY OF THE INVENTION

The primary objective of the present invention is to improve the efficiency in low-bit rate speech coding, especially in the unvoiced part of a speech signal where the random or noise_component, or equivalently, the rapidly evolving waveform becomes dominant. Accordingly, the first aspect of the present invention is a method of waveform interpolation speech coding for efficiently analyzing and reconstructing a speech signal. The method comprises the steps of:

decomposing the speech signal into a first component and a second component, wherein each of the waveform components has a power level;

determining the ratio of the power level of the first component to the power level of the second component; and encoding the first component with a first bit rate and the second component with a second bit rate, wherein the first and second bit rates are determined based on the ratio of the power level, wherein the first component includes a periodic component, or equivalently a slowly evolving waveform component, and the second component includes a random or noise component, or equivalently a rapidly evolving component.

In a broader sense, the method for waveform interpolation, according to the present invention, can be exploited in other types of speech coders, which estimate different components of the input signal. While in a WI coder, the power ratio is based on the slowly and rapidly evolving waveforms, the corresponding components in a Code Excited Linear Prediction (CELP) coder could be, for example, the long term prediction and fixed excitation signals, respectively.

Preferably, the method further comprises the step of modifying the slowly evolving waveform in order to improve the speech quality based on the ratio of the power level.

The second aspect of the present invention is a system for waveform interpolation speech coding. The system includes:

an encoder, responsive to an input signal indicative of a speech signal, for providing an output signal indicative of a power ratio and a plurality of waveform parameters;

a decoder, responsive to the output signal, for reconstructing the speech signal from the waveform parameters based on the power ratio, and for providing a reconstructed speech signal, wherein the input signal is decomposed in the encoder into a slowly evolving waveform component, having a first power level, and a rapidly evolving waveform component, having a second power level; and the power ratio is determined in the encoder by the ratio of the first power level to the second power level, and wherein the waveform parameters contain data representative of the slowly evolving waveform component and the rapidly evolving waveform component.

Preferably, the encoder includes a quantizer to encode the slowly evolving waveform component and the rapidly evolving waveform component into the plurality of waveform parameters according to a quantization scheme, and wherein the quantization scheme can be caused to change by the power ratio.

Furthermore, the slowly evolving waveform component includes a phase value, and the decoder comprises a phase modifying device for altering the phase value based on the power ratio prior to reconstructing the speech signal from the waveform parameters.

The third aspect of the present invention is an encoder for waveform interpolation speech coding. The encoder comprises:

a first device, responsive to an input signal indicative of a speech signal, for providing an output signal indicative of a power ratio and a plurality of waveform parameters, wherein the input signal is decomposed into a slowly evolving waveform component, having a first power level, and a rapidly evolving waveform component, having a second power level; and the power ratio is determined by the ratio of the first power level to the second power level, and wherein the waveform parameters contain data representative of the slowly evolving waveform component and the rapidly evolving waveform component; and a second device, responsive to the output signal, for encoding the waveform parameters based on the power ratio in order to provide a bit stream containing the encoded waveform parameters.

The fourth aspect of the present invention is a decoder for waveform interpolation speech coding. The decoder comprises:

a first device, responsive to an input signal, for providing an output signal, wherein the input signal is indicative of a plurality of waveform parameters of a slowly evolving waveform component, having a first power level, and a rapidly evolving waveform component, having a second power level; and wherein the slowly evolving waveform component has a phase value that can be caused to change based on a ratio of the first power level to the second power level; and a second device, responsive to the output signal, for synthesizing a speech waveform from the slowly evolving waveform component and the rapidly evolving waveform component, and for providing a speech signal indicative of the synthesized speech waveform.

The present invention will be apparent upon reading the description taken in conjunction with FIGS. 3 to 7.

DETAILED DESCRIPTION

Figure 1:
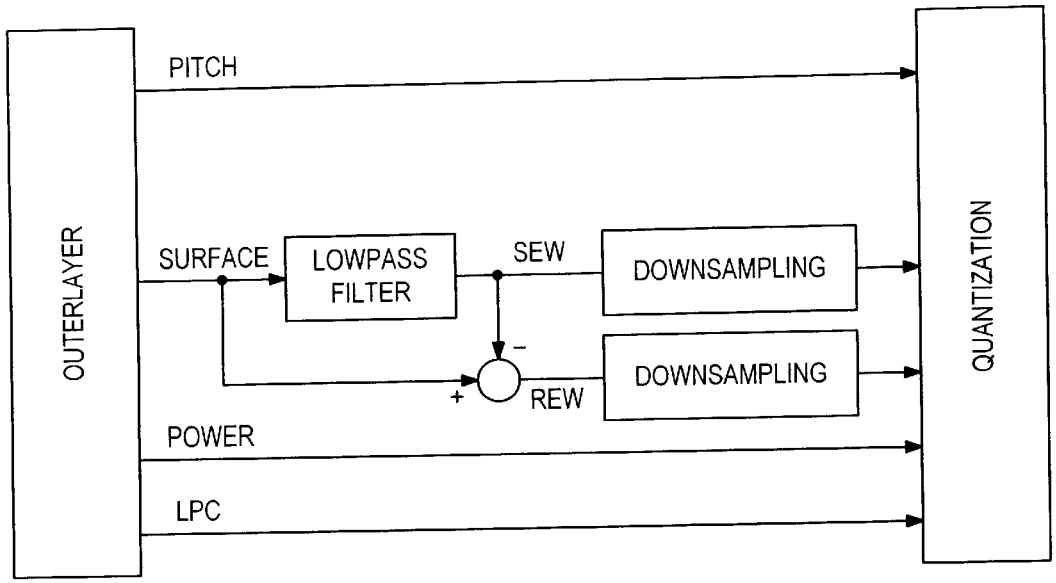
FIG. 1 is a diagrammatic representation illustrating a prior art waveform interpolation speech signal encoder.
Figure 3:
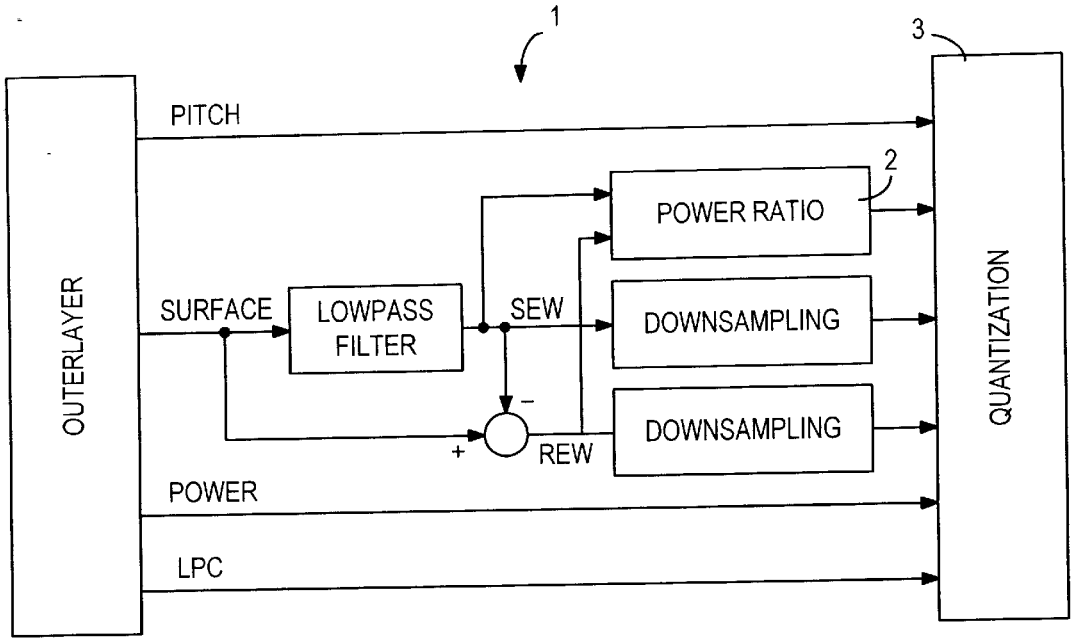
FIG. 3 is a diagrammatic representation illustrating a waveform interpolation speech signal encoder, according to the present invention.

FIG. 3 is used to illustrate the distinction between an encoder 1 according to the present invention and the prior art encoder, as shown in FIG. 1. As shown in FIG. 3, the encoder 1 has a device 2 to compute the ratio of the power level to the SEW component to the power level of the REW component, and the computed power ratio is conveyed to a quantization device 3.

Figure 2:
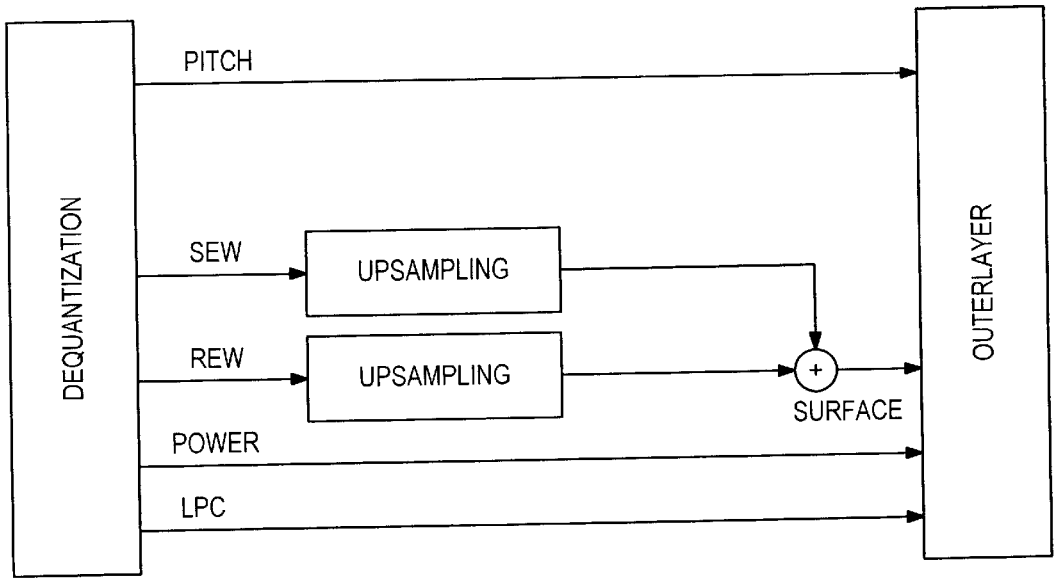
FIG. 2 is a diagrammatic representation illustrating a prior art waveform interpolation speech signal decoder.
Figure 4:
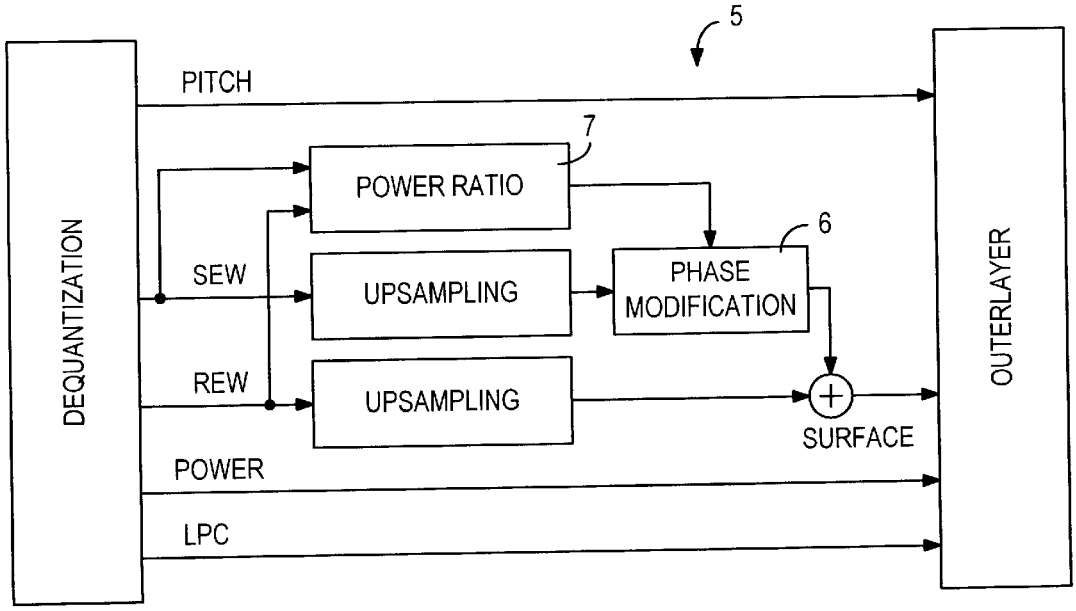
FIG. 4 is a diagrammatic representation illustrating a waveform interpolation speech signal decoder, according to the present invention.

Likewise, FIG. 4 is used to illustrate the distinction between a decoder 5 according to the present invention and the prior art decoder, as shown in FIG. 2. As shown in FIG. 4, the decoder 5 has a device 6 to modify the phases of the SEW component based on the power ratio. The power ratio can be obtained from the encoder 1 or from a computing device 7.

Figure 5:
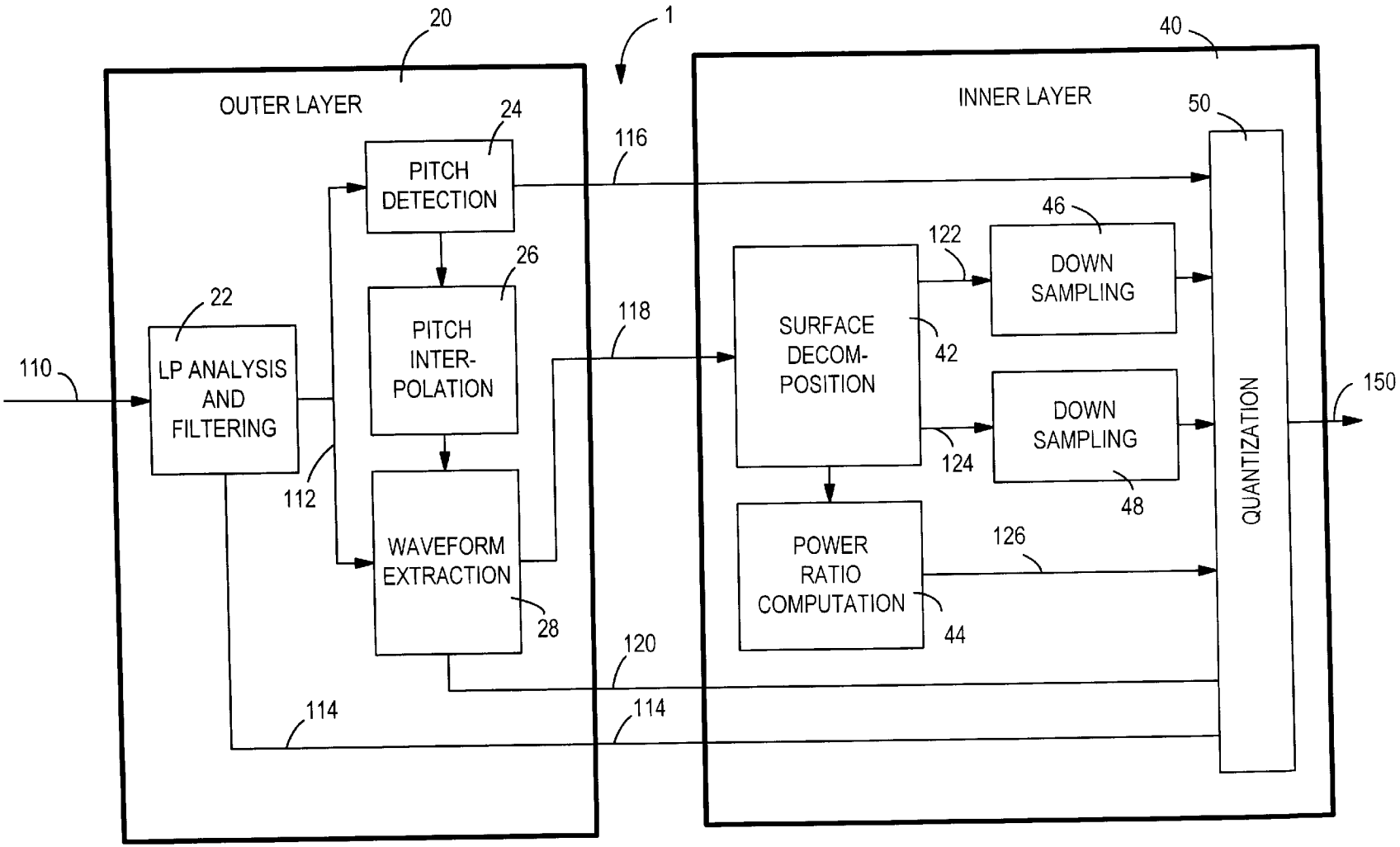
FIG. 5 is a block diagram illustrating the functions of the waveform interpolation speech signal encoder, according to the present invention.

FIG. 5 illustrates the functions of the waveform interpolation speech-signal encoder 1. As shown in FIG. 5, the encoder 1 can be functionally divided into an outer layer 20 and an inner layer 40 for processing an input speech signal s(t), which is denoted by numeral 110. As the input speech signal s(t) is conveyed to the encoder 1, the first operation performed on the input speech signal s(t) is the linear prediction (LP) analysis in order to generate a predicted signal, which is modeled after the short-term correlations between speech samples. Subsequently, the predicted signal is subtracted from the input signal s(t) to obtain the LP residual signal r(t), which is denoted by numeral 112. As shown in FIG. 3, the LP analysis is performed by an LP filter 22, which typically has an all-pole structure represented by:

$$1/A(z)=1/(1-a_1z^{-1}-\ldots-a_nz^{-n}), \tag{1}$$

where z is the pole and $(a_1, a_2, \ldots, a_n)$ are the LP coefficients in an n-degree LP filter. These LP coefficients are denoted by numeral 114. The LP residual signal r(t) can be expressed in terms of the LP coefficients as follows:

$$r(t)=A(z)s(t)=s(t)-a_1s(t-1)-a_2s(t-2)-\ldots-a_ns(t-n) \tag{2}$$

The analysis filter is the inverse of the synthesis filter 1/A(z). Another operation in the beginning of the coder is the pitch estimation carried by a pitch detection device 24 in order to estimate a pitch period, which is denoted by numeral 116. When the residual signal r(t) and the pitch period are found, the pitch period is linearly interpolated in device 26, and the outer layer 20 extracts characteristic waveforms from the residual signal r(t) at constant sampling intervals. The length of each characteristic waveform is equal to the pitch period estimated at that instant. The waveforms are presented by the discrete Fourier transform. At this stage, the waveforms are expressed as a function of phase, which varies from 0 to $2\pi$. Each characteristic waveform is aligned with the previous waveform so that the correlation between the waveforms attains its maximum.

A typical speech signal consists mainly of a mixture of periodic and non-periodic, or corresponding voiced and unvoiced, components. In unvoiced speech, the human auditory system observes only the magnitude spectrum and the power contour of the signal. In voiced speech, the characteristic waveform evolves slowly, and thus the information rate is relatively low. Because of the perceptually different characteristics between the voiced speech and the unvoiced speech, the separation of these two components is usually required for efficient coding. In general, the speech signal can be decomposed into a first component and a second component, wherein the first component includes a periodic component, or equivalently a slowly evolving waveform (SEW) component, and the second component includes a random or noise component, or equivalently a rapidly evolving waveform (REW) component. In WI coding, the separation is carried out by decomposing the surface $u(t,\phi)$ into a rapidly evolving waveform surface $u_R(t,\phi)$ and a slowly evolving waveform surface $u_S(t,\phi)$:

$$u(t,\phi)=u_R(t,\phi)+u_S(t,\phi) \tag{3}$$

In practice, a characteristic waveform is extracted from the residual signal r(t) at a discrete sampling instant $t_i$. Thus, at any discrete sampling instant $t_i$, the decomposition of the extracted surface can be expressed as $$u(t_i,\phi)=u_R(t_i,\phi)+u_S(t_i,\phi) \tag{4}$$

In decomposing the surface $u(t_i,\phi)$, a symmetric and non-causal low-pass filter is used. Let g(n) denote the nth coefficient of a linear-phase finite-impulse response (FIR) low-pass filter, then $u_S(t_i,\phi)$ can be obtained from $$u_S(t_i,\phi)=\Sigma g(n)u(t_{i+n},\phi), \tag{5}$$

for n=−M to M, and (2M+1) is the length of the impulse response. The rapidly evolving waveform $u_R(t_i,\phi)$ can be obtained from $$u_R(t_i,\phi)=u(t_i,\phi)-u_S(t_i,\phi) \tag{6}$$

Furthermore, the power $P(t_i)$ of the characteristic waveform at a discrete sampling can be calculated from $u(t_i,\phi)$ as follows:

$$P(t_i)=sqrt\left\{\left(1/p(t_i)\right)\sum_{n=1}^{p(t_i)}u\left(t_i2\pi n/p(t_i)\right)^2\right\}, \tag{7}$$

where $p(t_i)$ is an instantaneous period of the signal involved in the computation.

Similarly, the power $P_S(t_i)$ and $P_R(t_i)$ of the slowly evolving waveform $u_S(t_i,\phi)$ and the rapidly evolving waveform $u_R(t_i,\phi)$, respectively, can be computed as follows:

$$P(t_i)=sqrt\left\{\left(1/p(t_i)\right)\sum_{n=1}^{p(t_i)}u\left(t_i2\pi n/p(t_i)\right)^2\right\}, \tag{8}$$

and $$P(t_i)=sqrt\left\{\left(1/p(t_i)\right)\sum_{n=1}^{p(t_i)}u\left(t_i2\pi n/p(t_i)\right)^2\right\}, \tag{9}$$

Before conveying the surface signal $u(t_i,\phi)$ for surface decomposition, it is advantageous to normalize the surface signal with the power $P(t_i)$, which is denoted by numeral 120. As shown in FIG. 5, the normalized surface $u(t_i,\phi)$, which is denoted by numeral 118, is extracted by a waveform extraction device 28 and conveyed from the outer layer 20 to the inner layer 40 for surface decomposition. As shown in FIG. 5, the power-normalized surface $u(t_i,\phi)$ is decomposed into an SEW component 122 and an REW component 124 by a surface processing device 42. The power level $P_S(t_i)$ of the SEW component and the power level $P_R(t_i)$ of the REW component are calculated by a device 44 in order to determine the power ratio $\Gamma(t_i)=P_S(t_i)|P_R(t_i)$. The power ratio $\Gamma(t_i)$, which is denoted by numeral 126, is conveyed to a quantizer 50. The power ratio $\Gamma(t_i)$ can be used in two separate ways. It can be used by the quantizer 50 to change the quantization scheme in the encoder 1, and it can be used in the decoder 2 (FIG. 6) to improve the speech quality by modifying the phase information. As shown in FIG. 5, the SEW component 122 is down-sampled by a down-sampling device 46, and the REW component 124 is down-sampled by a down-sampling device 48 before these surface components are conveyed to the quantizer 50 for encoding.

The power ratio $\Gamma(t_i)$ can be interpreted as the degree of periodicity of the speech signal. In general, when the power ratio $\Gamma(t_i)$ is high, the quantization of the SEW surface should be emphasized. But when the power ratio $\Gamma(t_i)$ is low, the quantization of the REW surface should be emphasized. In the unvoiced period when the REW component is dominant, it is advantageous to change the bit allocation scheme so that the bits for the REW component are increased. It should be noted that the specific bit allocations and the possible number of different bit allocations can be varied. The bit allocation scheme partly depends on how the surface components are down-sampled. It also depends on the update rate and accuracy in representing the surface components. It is understood that the information regarding the quantization scheme will be used in the synthesis or reconstruction of the speech signal. This information can be conveyed to the decoder by assigning specific mode bit/bits when the quantization scheme is defined. Alternatively, the value $\Gamma(t_i)$ can be quantized directly and conveyed to the decoder as shown in FIG. 5, as part of the bit stream 150 to be conveyed from the encoder 1 to the decoder 5, as shown in FIG. 6.

Figure 6:
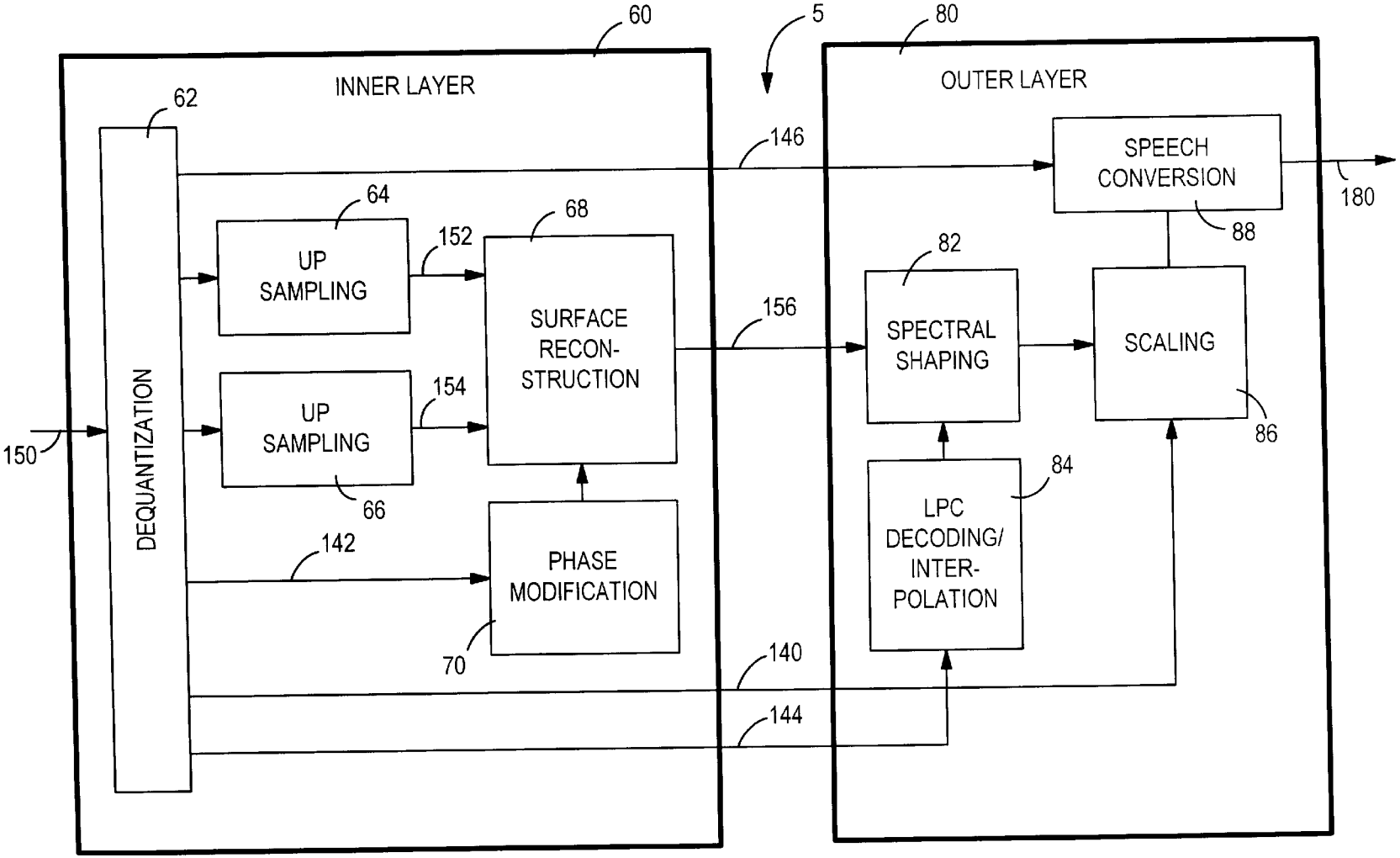
FIG. 6 is a block diagram illustrating the functions of the waveform interpolation speech signal decoder, according to the present invention.

As shown in FIG. 6, the decoder 5 can also be functionally divided into an inner layer 60 and an outer layer 80. The inner layer 60 receives the signal 150 from the encoder 1 and decodes the received signal using a dequantization device 62. From the received signal 150, the dequantization device 62 also obtains the power $P(t_i)$, the power ratio $\Gamma(t_i)$, the LP coefficients, and the pitch, as denoted by numerals 140, 142, 144 and 146, respectively. After being up-sampled by up-sampling devices 64 and 66, the SEW and REW components are recovered, as denoted by numerals 152 and 154. As shown, a surface reconstruction device 68 is used to synthesize the residual surface $u(t_i,\phi)$ from the SEW and REW components 152 and 154. It should be noted that at low bit rates, the phases of the SEW portion are often set to a fixed value or coarsely quantized. This is based on the fact that the human auditory system is relatively insensitive to phase information in the speech signal. However, using only a limited number of phase values would result in unwarranted periodicity in the reconstructed speech signal. This is particularly more noticeable in an unvoiced speech section as a humming background. Thus, in order to increase the natural-sounding aspect of the reconstructed speech, a random term can be added to the SEW phases. As shown in FIG. 6, the power ratio $\Gamma(t_i)$ is used as a criteria for a phase modification device 70 to modify the SEW phases.

During a clearly voiced section of a speech where the power ratio $\Gamma(t_i)$ is high, it may not be necessary to modify the phase information. But when the power ratio $\Gamma(t_i)$ is low, it can be used to control the degree of randomness by incorporating an additional random term into the SEW phases.

The modification of the SEW phases can be carried out in accordance with the following equations:

$$\phi'_{Sk}(t_i)=\phi_{Sk}(t_i)+\eta 2\pi\{\xi-\ln(\Gamma(t_i))\}\rho_k(t_i),\ \text{for } \ln(\Gamma(t_i))<\xi$$

$$\phi'_{Sk}(t_i)=\phi_{Sk}(t_i),\ \text{for } \ln(\Gamma(t_i))\leq\xi$$

where $\xi$ and $\eta$ are scaling factors and $\rho_k(t_i)$ is a random number in the range [−1, 1]. The values of $\xi=0.5$ and $\eta=1.0$ can be used for the SEW phase modification, for example. However, other values can also be used. More generally, the phase modification can be expressed as $$\phi'_{Sk}(t_i)=\phi_{Sk}(t_i)+\psi(\Gamma(t_i))$$

where the value of $\psi(.)$ depends on $\Gamma(t_i)$.

The outer layer 80 of the decoder 5 is well known in the art. As shown in FIG. 6, the residual surface is converted by LP synthesis to speech domain by a spectral shaping device 82. The interpolated LP coefficients needed for synthesis are generated by a device 84. The obtained speech surface is then scaled with the power $P(t_i)$ by a scaling device 86 and converted into a one-dimensional signal by a conversion device 88 using the pitch 146.

Figure 7:
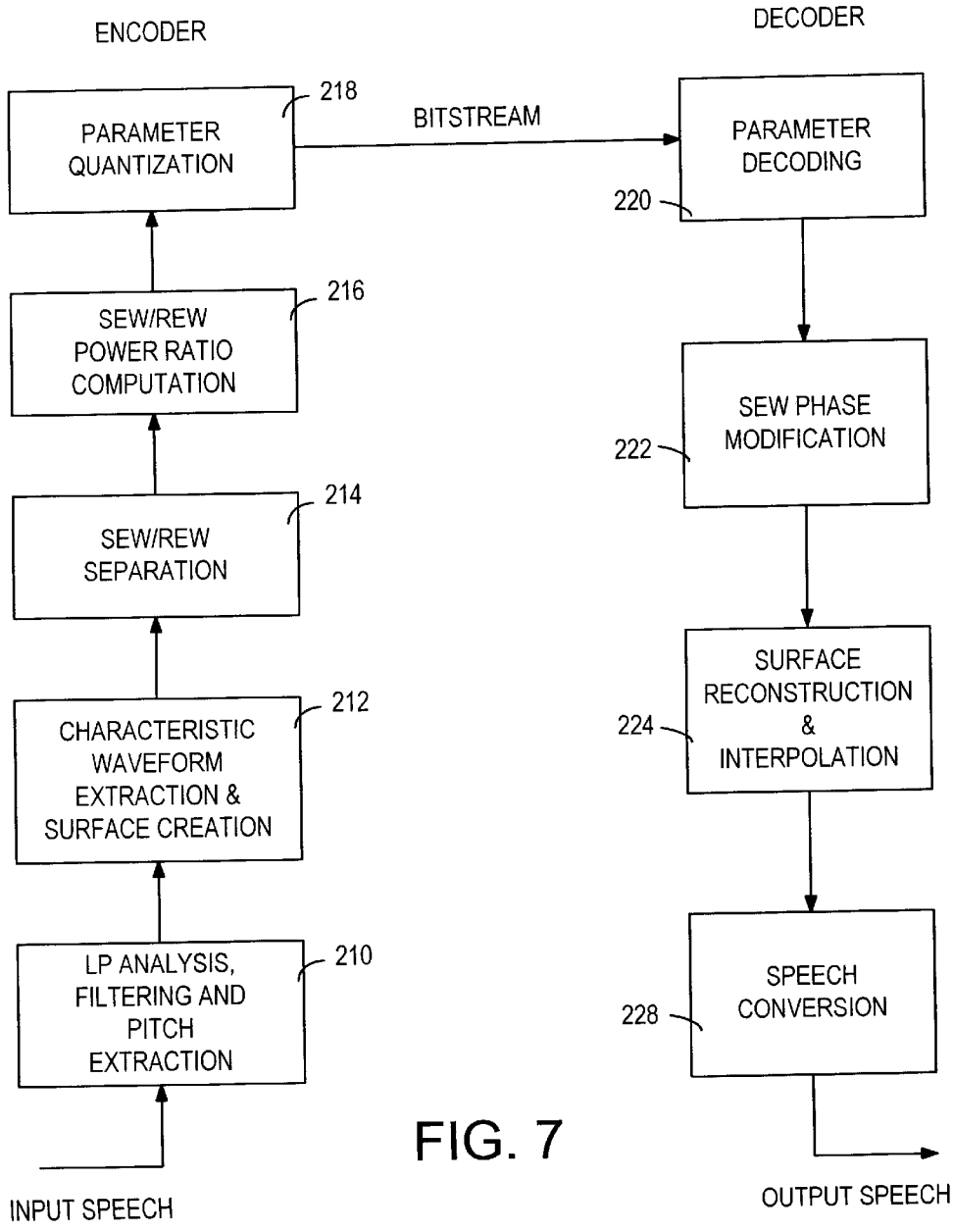
FIG. 7 is a flow chart illustrating a method for waveform interpolation speech signal coding, according to the present invention.

The method of waveform interpolation speech coding is illustrated in FIG. 7. As shown, an input speech signal is analyzed and filtered, and the pitch is estimated at step 210. A waveform surface is extracted at step 212 so that the surface can be decomposed at step 214 into a SEW component and an REW component. At the same time, the ratio of the power level of the SEW component to the power level of the REW component is computed at step 216. The LP coefficients, the surface components and other waveform parameters are quantized and formatted into a bit stream at step 218. The quantization scheme used in the quantization of the surface components can be based on the power ratio computed at step 216. The bit stream carries the speech information from the encoder side to the decoder side. On the decoder side, the bit stream is dequantized at step 220 to obtain the surface components, the pitch, the power ratio and other waveform parameters. If necessary, the SEW phases are modified based on the power ratio at step 222. The waveform surface is reconstructed and interpolated at step 224 to recover the LP residual speech signal. Finally, the LP coefficients are combined with the residual surface to synthesize a speech signal at step 228.

It should be noted that, the method of waveform interpolation speech coding of the present invention as described above, can also be exploited in other types of speech coders, such as in Code Excited Linear Prediction (CELP) and sinusoidal coders, where the periodic and random components are estimated and coded.

Thus, the present invention has been disclosed with respect to the preferred embodiment thereof It will be understood by those skilled in the art that the foregoing and various other changes, omissions and deviations in the form and detail thereof may be made without departing from the spirit and scope of this invention.

What is claimed is:

1. A method of speech coding for analyzing a speech signal, said method comprising the steps of:

obtaining a slowly evolving waveform component and a rapidly evolving waveform component from the speech signal, wherein the slowing evolving waveform component has a first power level and the rapidly evolving waveform component has a second power level;

determining a power ratio value representative of a ratio of the first power level to the second power level;

encoding the slowly evolving waveform component with a first bit rate and the rapidly evolving waveform component with second bit rate, wherein the first and second bit rates are determined based on the power ratio value.

2. The method of claim 1, wherein the slowly evolving waveform component includes a period component and the rapidly evolving waveform component includes a random component.

3. The method of claim 1, further comprising the step of extracting a characteristic waveform surface from the speech signal in order to obtain the slowly evolving waveform component and the rapidly evolving waveform component from the characteristic waveform surface.

4. The method of claim 3, further comprising the steps of extracting a pitch from the speech signal and encoding the pitch.

5. The method of claim 4, further comprising the step of providing a bit-stream indicative of the encoded slowly evolving waveform component, encoded rapidly evolving waveform component and the encoded pitch in order to reconstruct the speech signal based on the bit-stream.

6. The method of claim 5, further comprising the steps of:

receiving the bit-stream;

decoding the encoded rapidly evolving waveform component;

decoding the encoded slowly evolving waveform component, wherein the decoded slowly evolving waveform component has a phase value; and modifying the phase value of the decoded, slowly evolving waveform component based on the power ratio value.

7. A system for speech coding comprising:

encoding means, responsive to an input signal indicative of a speech signal, for providing output signal indicative of a power ratio and a plurality of waveform parameters;

decoding means, responsive to said output signal, for reconstructing the speech signal from the waveform parameters based on the power ratio, and for providing a reconstructed speech signal, wherein the input signal is decomposed in said encoding means into a slowly evolving waveform component and a rapidly evolving waveform component, wherein the slowing evolving waveform has a first power level and the rapidly evolving waveform has a second power level;

the power ratio is determined in said encoding means by a ratio of the first power level to the second power level; and the waveform parameters contain data representative of the slowly evolving waveform component encoded in a first data rate and the rapidly evolving waveform component encoded in a second data rate, wherein the first data rate and the second data rate are determined based on the power ratio.

8. The system of claim 7, wherein the slowly evolving waveform component includes a period component and the rapidly evolving waveform component includes a random component.

9. The system of claim 7, wherein the encoding means comprises a quantization means to encode the slowly evolving waveform component and the rapidly evolving waveform component into the plurality of waveform parameters according to a quantization scheme, and wherein said quantization scheme can be caused to change by the power ratio.

10. The system of claim 7, wherein the slowly evolving waveform component includes a phase value and wherein the decoding means comprises a phase modifying means for altering the phase value, based on the power ratio, prior to reconstructing the speech signal from the waveform parameters.

11. An encoding apparatus for speech coding comprising:

means, responsive to an input signal indicative of a speech signal, for providing a first output signal indicative of a slowly evolving waveform component having a first power level and a rapidly evolving waveform component having a second power level, wherein the first component and the second component are obtained from the input signal;

means, responsive to the first output signal, for providing a second output signal indicative of a power ratio and a plurality of waveform parameters, wherein the power ratio is determined by a ratio of the first power level to the second power level, and the waveform parameters contain data representative of the slowly evolving waveform component and the rapidly evolving waveform component; and means, responsive to the second output signal, for encoding the waveform parameters based on the power ratio in order to provide a bit-stream containing the encoded waveform parameters.

12. The encoding apparatus of claim 11, wherein the slowly evolving waveform component includes a period component and the rapidly evolving waveform component includes a random component.

13. The encoding apparatus of claim 11, wherein the waveform parameters are encoded based on the power ratio.

14. The encoding apparatus of claim 11, further comprising means for extracting a characteristic waveform surface from the speech signal so that the slowly evolving waveform component and the rapidly evolving waveform component can be obtained from the characteristic waveform surface.

15. The encoding apparatus of claim 14, further comprising means for extracting a pitch from the speech signal, wherein the waveform parameters contain further data representative of the slowly evolving waveform component, the rapidly evolving waveform component, and the pitch.

16. A decoding apparatus for speech coding comprising:

means, responsive to an input signal, for providing an output signal, wherein the input signal is indicative of a plurality of speech parameters extracted from a speech signal, and wherein the speech parameters include:

a slowly evolving waveform component having a first power level and a phase value;

a rapidly evolving waveform component having a second power level, wherein the phase value is modifiable based on a ratio of the first power level to the second power level, and the output signal is indicative of the modified speech parameters; and means, responsive to the output signal, for synthesizing a speech waveform indicative of the speech signal, and for providing a signal indicative of the synthesized speech waveform.

17. The decoding apparatus of claim 16, wherein the slowly evolving waveform component includes a period component and the rapidly evolving waveform component includes a random component.

18. The decoding apparatus of claim 16, wherein the speech parameters include a pitch, a surface constructed from the slowly evolving waveform component, the rapidly evolving waveform component and the phase value.

* * * * *